US006023949A

United States Patent [19]

Lonati et al.

[11] Patent Number: 6,023,949

[45] Date of Patent: Feb. 15, 2000

[54] CIRCULAR KNITTING MACHINE WITH DRIVE ROLL FEED BACK DEVICE FOR TENSIONING THE KNITTED FABRIC

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/123,394

[22] Filed: Jul. 15, 1998

[30] Foreign Application Priority Data

Jul. 25, 1997 [IT] Italy ..... MI97A1785

[51] Int. Cl.[7] ..... D04B 15/88

[52] U.S. Cl. ..... 66/153; 66/149 R; 139/110

[58] Field of Search ..... 66/153, 151, 149 R; 139/110

[56] References Cited

U.S. PATENT DOCUMENTS 5,381,676 1/1995 Shibata et al. ..... 66/149 R
5,386,855 2/1995 Corain ..... 139/110
5,730,005 3/1998 Chen ..... 66/153

*Primary Examiner*—Andy Falik
*Attorney, Agent, or Firm*—Guido Modiano; Albert Josif; Daniel J. O'Byrne

[57] ABSTRACT

A circular machine for knitting or hosiery with a device for tensioning the knitted fabric, the tensioning device comprising at least two tensioning rollers which are arranged below the needle work area and are arranged substantially horizontally. The tensioning rollers face each other and actuation elements are provided which act on at least one of the tensioning rollers to turn it about the corresponding axis in order to tension the knitted fabric which is formed by the needles and passes between the tensioning rollers. The tensioning device comprises first detection elements for detecting the degree of tension of the fabric in a region of the portion of fabric that lies between the needle work area and the tensioning rollers. The first detection device is operatively connected to the first actuation element in order to vary or maintain the rotation rate of the tensioning rollers as a function of the detected tension degree tension and of a preset tension degree.

11 Claims, 3 Drawing Sheets

CIRCULAR KNITTING MACHINE WITH DRIVE ROLL FEED BACK DEVICE FOR TENSIONING THE KNITTED FABRIC

BACKGROUND OF THE INVENTION

The present invention relates to a circular machine for knitting or hosiery with a device for tensioning the knitted fabric.

Knitted fabric tensioning devices for large- and medium-diameter single-cylinder circular machines, for tensioning the knitted fabric that is formed continuously with a considerable length, are known. These tensioning devices generally comprise two or three tensioning rollers which are arranged so that their axes are horizontal and face each other. The tensioning rollers are arranged below the needle work area of the machine and the fabric formed by the needles passes between said tensioning rollers. At least one of the tensioning rollers is rotated about its own axis so as to tension the fabric that is gradually formed by the needles and passes between the tensioning rollers. The fabric that leaves the tensioning rollers is then wound onto a roll which is arranged below the tensioning rollers in the footing of the machine.

The electric motor that drives at least one of the tensioning rollers, in these conventional tensioning devices, is usually driven with a torque which corresponds to the chosen tension degree. A potentiometer is installed on the power supply circuit of the electric motor and allows to vary the torque of the motor, thus varying the degree of tension of the fabric in order to adapt it to the various production requirements.

Some problems have been observed in the use of these tensioning devices.

A first problem is the difficulty in determining the size of the reduction unit that connects the electric motor to at least one of the tensioning rollers. In order to achieve an adequate degree of tension while using a compact electric motor with a modest power rating, it is necessary to use a very high reduction ratio. Consequently, transmission of the motion from the motor to the tensioning roller entails high inertia in achieving a variation in the degree of tension of the fabric when the tensioning requirements related to the current production change.

Moreover, with conventional tensioning devices the degree of tension of the fabric cannot be checked in order to ensure that it actually corresponds to the intended tension degree.

SUMMARY OF THE INVENTION

The aim of the present invention is to solve the above problems by providing a circular machine for knitting or hosiery which is provided with a knitted fabric tensioning device which can vary, very quickly and precisely, the degree of tension applied to the fabric during its production.

Within the scope of this aim, an object of the present invention is to provide a circular machine for knitting or hosiery which is provided with a device for tensioning the knitted fabric which allows to check the actual degree of tension of the fabric and to vary it quickly in order to bring it to a preset value.

Another object of the present invention is to provide a circular machine for knitting or hosiery provided with a device for tensioning the knitted fabric which can also wind the fabric on a roll with a preset tension degree.

This aim, these objects and others which will become apparent hereinafter are achieved by a circular machine for knitting or hosiery with a device for tensioning the knitted fabric, comprising at least two tensioning rollers arranged below the needle work area of the machine, said tensioning rollers being arranged horizontally and facing each other, first actuation means being provided which act on at least one of said tensioning rollers to turn it about the corresponding axis in order to tension the knitted fabric which is formed by the needles and passes between said at least two tensioning rollers, characterized in that it comprise first means for detecting the degree of tension of the fabric in a region of the portion of fabric that lies between the needle work area and said tensioning rollers, said first detection means being operatively connected to said first actuation means in order to vary or maintain the rotation rate of said tensioning rollers as a function of the detected tension degree and of a preset tension degree.

BRIEF DESCRIPTION OF THE DRAWINGS

Further characteristics and advantages of the invention will become apparent from the following detailed description of a preferred but not exclusive embodiment of the circular machine for knitting or hosiery with the device for tensioning the knitted fabric according to the present invention, illustrated only by way of non-limitative example in the accompanying drawings, wherein.

DESCRIPTION OF THE PREFERRED EMBODIMENTS

Figure 1:
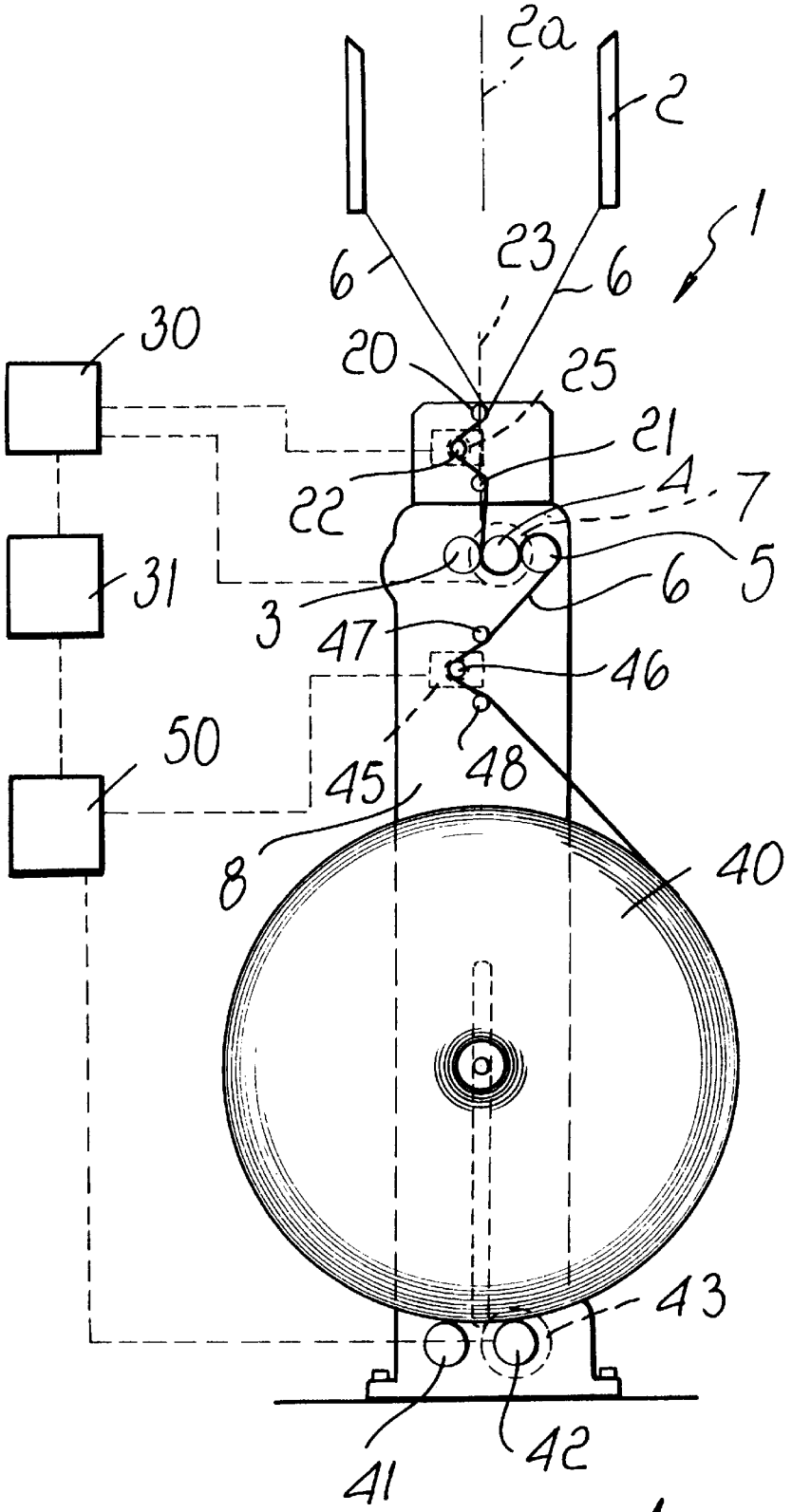
FIG. 1 is a schematic lateral elevation view of the machine with the tensioning device according to the invention.
Figure 2:
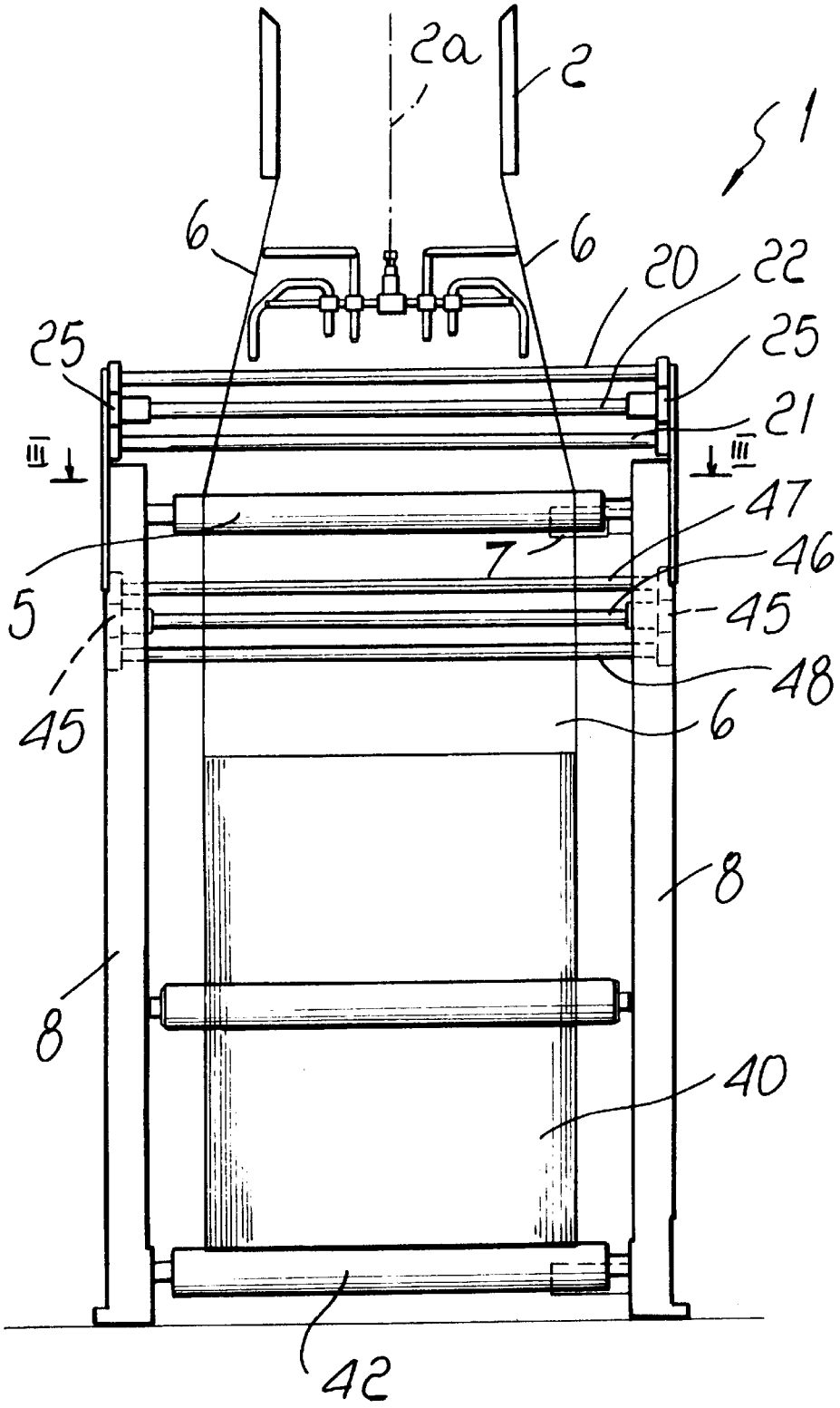
FIG. 2 is a schematic front elevation view of the machine with the tensioning device.

With reference to the above figures, the circular machine for knitting or hosiery, generally designated by the reference numeral 1 and provided with the device for tensioning the knitted fabric, comprises in a per se known manner a needle cylinder 2 which can be turned about its own axis 2*a*. The knitted fabric tensioning device comprises at least two tensioning rollers which are arranged below the work area of the needles of the needle cylinder 2 and are arranged horizontally and so as to face each other.

More particularly, in the illustrated embodiment there are provided three tensioning rollers, designated by the reference numerals 3, 4 and 5 respectively, which are arranged so that their axes are horizontal and face each other laterally with their cylindrical surface so as to form a path for the fabric 6 that gradually leaves the work area of the needles of the needle cylinder 2 and passes through the roller 3 and the roller 4 and is then guided through the roller 4 and the roller 5.

As an alternative, it is in any case possible to use two rollers, for example the rollers 3 and 4, between which the knitted fabric 6 to be tensioned passes.

The tensioning device according to the invention comprises first actuation means, which act on at least one of the tensioning rollers in order to turn it about the corresponding axis so as to tension the knitted fabric 6 that passes between the tensioning rollers.

Figure 3:
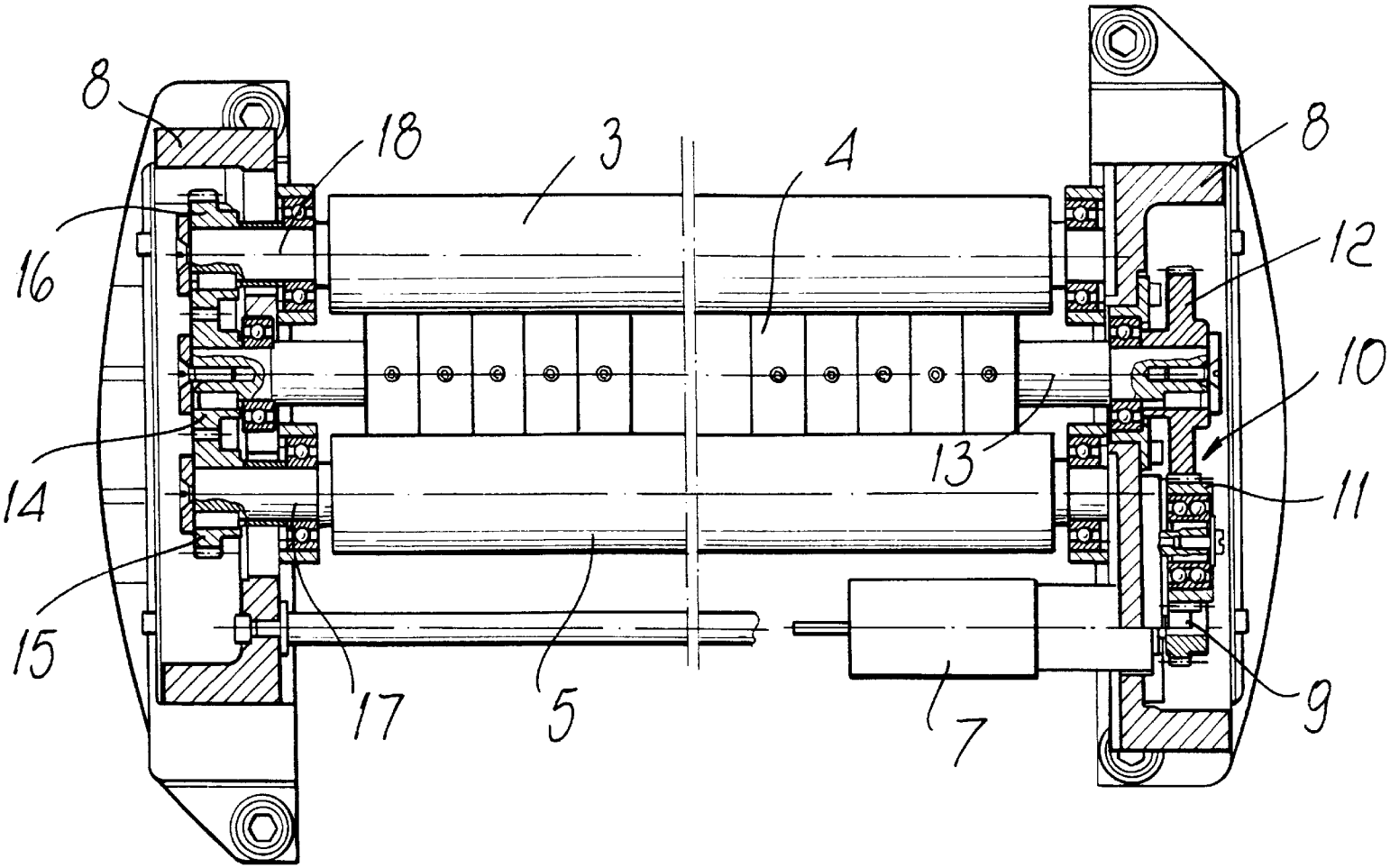
FIG. 3 is a schematic sectional view of FIG. 2, taken along the plane III—III, with some details omitted for the sake of clarity.

The first actuation means comprise, as shown in particular in FIG. 3, a variable-speed electric motor 7 which is preferably constituted by a DC electric motor which is mounted on a frame 8 which can rotate about the axis 2*a* rigidly with the needle cylinder 2. The electric motor 7 is connected, by means of its output shaft 9, to the input of a gearmotor, generally designated by the reference numeral 10, which has in output a gear 11 which meshes with a gear 12 which is keyed to one end of the shaft 13 that supports the roller 4. The roller 4 is supported, so that it can rotate about the corresponding axis 4*a*, by said frame 8 and is provided, at the end that is furthest from the end that supports the gear 12, with another gear 14 which meshes with gears 15 and 16 which are respectively keyed on an axial end of the shaft 17 that supports the roller 5 and on the axial end of a shaft 18 that supports the roller 3.

The rollers 3 and 5 can be pressed, through adapted elastic means, against the cylindrical surface of the roller 4, in a per se known manner which is not illustrated for the sake of simplicity.

According to the invention, first means are provided for detecting the degree of tension of the fabric 6 in the region between the work area of the needles of the needle cylinder 2 and the tensioning rollers 3, 4 and 5. Said first detection means are furthermore operatively connected to the first actuation means in order to vary or maintain the rotation rate of the tensioning rollers as a function of the detected tension degree and of a preset tension degree.

More particularly, three guiding rollers, designated by the reference numerals 20, 21 and 22 respectively, are arranged between the needle work area and the tensioning rollers 3, 4 and 5 so that their axes are horizontal and parallel to the axes of the tensioning rollers 3, 4 and 5 and are supported, so that they can rotate about their respective axes, by said frame 8.

The guiding rollers 20 and 21 are spaced from each other and the roller 22, or intermediate guiding roller, is arranged between the rollers 20 and 21 and is laterally spaced with respect to an imaginary vertical plane 23 that contains the axes of the guiding rollers 20 and 21. The fabric 6 forms, between the rollers 20 and 21, a loop which is stretched by the intermediate guiding roller 22, which is supported by the frame 8 so that is can move at right angles to the plane 23. The first detection means, preferably constituted by a load cell 25, are arranged between the intermediate guiding roller 22 and the frame 8.

Preferably, two load cells 25 are provided and arranged between the two axial ends of the intermediate guiding roller 22 and the supporting frame 8.

The two load cells 25 are connected in parallel to an electronic comparator 30, which is suitable to compare the tension degree detected by the load cells 25 with a tension degree which is preset in the comparator 30.

The use of two load cells 25 instead of a single load cell and the parallel connection of these two load cells with the comparator 30, which averages the measurements made by the two load cells 25, reduces the possibility of error in detecting the degree of tension of the fabric.

The comparator 30 can be connected to a central control unit 31 which supervises the operation of the entire machine and supplies, in each instance, as a function of the production in progress, the value of the preset tension degree to the comparator 30.

A roll 40 is provided below the tensioning rollers 3, 4 and 5 and has a horizontal axis which is parallel to the axis of the tensioning rollers 3, 4 and 5 and is supported by two supporting rollers 41 and 42 which are also supported by the frame 8 so that they can rotate about their respective axes, which are horizontal and parallel to the axis of the roll 40 and to the axis of the tensioning rollers 3, 4 and 5.

In practice, the roll 40 on which the fabric 6 that leaves the tensioning rollers 3, 4 and 5 is wound rests on the rollers 41 and 42, at least one of which is actuated by a gearmotor 43 which preferably has a variable-speed electric motor, for example a DC electric motor.

Conveniently, second detection means are provided which are interposed between the tensioning rollers 3, 4 and 5 and the roll 40 and are suitable to detect the degree of tension of the fabric wound onto the roll 40.

The second detection means are preferably also constituted by a load cell 45 or by a pair of load cells interposed between an intermediate guiding roller 46 which is arranged between two guiding rollers 47 and 48.

In practice, the guiding rollers 46, 47 and 48 are provided substantially like the guiding rollers 20, 21 and 22, i.e., they are arranged so that their axes are parallel to the axis of the tensioning rollers and are supported by the frame 8 so that they can rotate about their respective axes. The intermediate guiding roller 46 is spaced with respect to the imaginary plane that passes through the axes of the guiding rollers 47 and 48 and is supported by the frame 8 so that it can move at right angles to said imaginary plane. A load cell 45 is interposed between the frame 8 and the intermediate guiding roller 46 and supplies in output a signal which is proportional to the degree of tension of the fabric that forms, between the rollers 47 and 48, a loop which is stretched by the intermediate guiding roller 46.

The load cell or cells 45 arranged between the intermediate guiding roller 46 and the frame 8 is or are connected to another comparator 50, in which a preset tension degree is set; said preset tension degree is compared in each instance with the degree of tension detected by the load cell or cells 45 arranged on the intermediate guiding roller 46, and said comparator 50 acts on the motor of the gearmotor 43 that drives the supporting roller 42 so as to maintain or vary the rotation rate of the motor depending on whether the detected tension degree is equal or different with respect to the preset tension degree.

The value of the degree of tension preset in the comparator 50 can also be provided by the programmable control and actuation unit 31 that supervises the operation of the entire machine.

The operation of the machine with the fabric tensioning device according to the invention is as follows.

Depending on the production in progress, the control and actuation unit 31 provides the comparator 30 and optionally the comparator 50 with preset tension values.

The knitted fabric 6 formed by the needles of the needle cylinder 2 passes through the guiding rollers 20, 22 and 21, through the tensioning rollers 3, 4 and 5, and then through the guiding rollers 46, 47 and 48 and then winds onto the roll 40.

The load cell or cells 25 measure, in each instance, the degree of tension of the fabric 6 and send this tension signal to the comparator 30, which compares it with the value of the preset tension degree. If the value of the detected tension degree is equal to the value of the preset tension degree, the comparator 30 does not act on the motor 7 that drives the tensioning rollers; if instead the value of the detected tension degree is different from the value of the preset tension degree, the comparator 30 intervenes by varying the rotation rate of the motor 7 that drives the tensioning rollers 3, 4 and 5, so as to bring the tension degree to a value which is equal to the value of the preset tension degree.

The same occurs of the tension of the fabric 6 in the region between the tensioning rollers 3, 4 and 5 and the roll 40. In practice, the load cell or cells 45 arranged on the intermediate guiding roller 46 send a signal which corresponds to the degree of tension in this region to the comparator 50, which compares this value of the tension degree with a value of the preset tension degree and optionally acts on the motor that drives the supporting roller 42 so as to maintain or correspondingly vary the rotation rate of the roll 40 and therefore the tension of the fabric in the region between the tensioning rollers 3, 4 and 5 and the roll 40.

In this manner it is possible to control and vary, according to the process requirements and to the requirements of the winding of the fabric on the roll, the tension degree so as to make it match the preset tension degree.

In practice, it has been observed that the machine with the knitted fabric tensioning device according to the invention fully achieves the intended aim and objects, since it allows to control and vary, in a very short time, the degree of tension of the fabric during its production.

The machine with the fabric tensioning device thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Application No. I97A01785 from which this application claims priority are incorporated herein by reference.

What is claimed is:

1. A circular machine for knitting or hosiery with a device for tensioning the knitted fabric, comprising at least two tensioning rollers which are arranged below the needle work area of the machine, said tensioning rollers being arranged horizontally and facing each other, first actuation means being provided which act on at least one of said tensioning rollers to turn it about the corresponding axis in order to tension the knitted fabric which is formed by needles of the machine and passes between said at least two tensioning rollers, the machine further comprising first detection means for detecting the degree of tension of the fabric in a region of the portion of fabric that lies between the needle work area and said tensioning rollers, said first detection means being operatively connected to said first actuation means in order to vary or maintain the rotation rate of said tensioning rollers as a function of the detected tension degree and of a preset tension degree, and between the needle work area and said tensioning rollers three guiding rollers are provided which are arranged so that their axes are parallel to the axis of said tensioning rollers and are supported by a supporting frame so that they can rotate about their own axes, said guiding rollers comprising two mutually spaced guiding rollers and an intermediate roller whose axis is spaced from the imaginary plane that passes through the axes of said two guiding rollers, said guiding rollers forming, for the knitted fabric, a portion of a path with a loop which is stretched by said intermediate guiding roller, said intermediate guiding roller having a supporting structure which is configured such that said intermediate guiding roller is movable with respect to said supporting frame in a direction which is substantially perpendicular to said imaginary plane, and said first detection means comprise a load cell interposed between said intermediate roller and said supporting frame.

2. A machine according to claim 1, wherein said first detection means are connected to said first actuation means by means of a comparator for comparing the detected tension degree with the preset tension degree and to drive said first actuation means accordingly.

3. A machine according to claim 1, wherein said first detection means comprise two load cells which are interposed between the longitudinal ends of said intermediate roller and said supporting frame, said two load cells being parallel-connected to said comparator for averaging the value detected by said two load cells and to compare said average with said preset tension degree.

4. A machine according to claim 3, wherein said comparator is connected to a programmable control and actuation unit for providing, in each instance, said comparator with the value of said preset tension degree as a function of the process being performed on the machine.

5. A circular machine for knitting or hosiery with a device for tensioning the knitted fabric, comprising at least two tensioning rollers which are arranged below the needle work area of the machine, said tensioning rollers being arranged horizontally and facing each other, first actuation means being provided which act on at least one of said tensioning rollers to turn it about the corresponding axis in order to tension the knitted fabric which is formed by needles of the machine and passes between said at least two tensioning rollers, the machine further comprising first detection means for detecting the degree of tension of the fabric in a region of the portion of fabric that lies between the needle work area and said tensioning rollers, said first detection means being operatively connected to said first actuation means in order to vary or maintain the rotation rate of said tensioning rollers as a function of the detected tension degree and of a preset tension degree, the machine further comprising, at the output of said tensioning rollers, a fabric winding roll which is arranged so that is axis is parallel to said tensioning rollers, said roll being arranged on a pair of supporting rollers whose axes are parallel to the axis of the roll; second actuation means being provided which act on at least one of said supporting rollers in order to turn it about the corresponding axis so as to turn said roll about its own axis.

6. A machine according to claim 5, wherein second detection means for detecting the degree of tension of the fabric being wound on said roll are interposed between said tensioning rollers and said roll, said second detection means being operatively connected to said second actuation means in order to vary or maintain the rotation rate of the roll as a function of the detected tension degree and of the preset tension degree.

7. A machine according to claim 6, wherein said second detection means are connected to said second actuation means by means of a second comparator for comparing the degree of tension detected by said second detection means with the preset tension degree and to correspondingly drive said second actuation means.

8. A machine according to claim 7, wherein said second detection means comprise a load cell.

9. A machine according to claim 7, wherein said second comparator is connected to a programmable control and actuation unit for supplying, in each instance, said second comparator element with the value of said preset tension degree as a function of the production in progress on the machine.

10. A machine according to claim 6, wherein three additional guiding rollers are provided between said tensioning rollers and said roll and are arranged so that their axes are parallel to the axes of said tensioning rollers and are supported by said supporting frame so that they can rotate about their axes, said additional guiding rollers comprising two mutually spaced guiding rollers and an intermediate roller whose axis is spaced from the imaginary plane that passes through the axes of said two guiding rollers, said additional guiding rollers forming, for the knitted fabric, a portion of a path with a loop which is stretched by the corresponding intermediate guiding roller, said intermediate guiding roller having a supporting structure which is configured such that said intermediate guiding roller is movable with respect to said supporting frame in a direction which is substantially perpendicular to said imaginary plane, and said load cell being interposed between said intermediate guiding roller and said supporting frame.

11. A machine according to claim 10, wherein said second detection means comprise two load cells which are interposed between the longitudinal ends of said intermediate roller of the additional guiding rollers and said supporting frame, said two load cells being parallel-connected to said second comparator, for averaging the values detected by said load cells and to compare said average with the preset tension degree.

* * * * *